US005954257A

United States Patent [19]

Panneri et al.

[11] Patent Number: 5,954,257

[45] Date of Patent: Sep. 21, 1999

[54] TAPE DISPENSER

[75] Inventors: Alfred J. Panneri, Cheektowaga; Louis Terragnoli, Williamsville, both of N.Y.

[73] Assignee: A. J. Panneri Enterprises, Inc., Cheektowaga, N.Y.

[21] Appl. No.: 09/028,378

[22] Filed: Feb. 24, 1998

[51] Int. Cl.[6] ..... B26F 3/00

[52] U.S. Cl. ..... 225/39; 225/42; 225/49; 225/51; 225/82; 225/87

[58] Field of Search ..... 225/39, 41, 42, 225/46, 47, 48, 49, 51, 77, 82, 87, 106

[56] References Cited

U.S. PATENT DOCUMENTS

| | | | |
|---|---|---|---|
| 2,275,408 | 3/1942 | Alliss | 225/90 |
| 2,295,477 | 9/1942 | Jackson | 225/90 |
| 2,626,666 | 1/1953 | Coldiron | 225/90 |
| 3,069,055 | 12/1962 | Steele et al. | 225/41 |
| 3,125,263 | 3/1964 | Harbour | 225/51 |
| 3,489,324 | 1/1970 | Stohl | 225/42 |
| 3,972,459 | 8/1976 | Cooper | 225/47 |
| 3,989,175 | 11/1976 | Cherrin | 225/46 |
| 4,447,281 | 5/1984 | Joy | 225/39 |
| 4,447,482 | 5/1984 | Heinzelman et al. | 225/106 |
| 4,752,023 | 6/1988 | Lin | 225/90 |
| 4,817,798 | 4/1989 | Huang | 225/77 |
| 5,123,582 | 6/1992 | Lo | 225/47 |
| 5,350,099 | 9/1994 | Kienzle | 225/77 |

*Primary Examiner*—M. Rachuba
*Attorney, Agent, or Firm*—Joseph P. Gastel

[57] ABSTRACT

A tape dispenser including spaced side walls, inner sides on the side walls, first and second end portions on the side walls, a hub member mounted on each of the inner sides of the side walls in spaced facing relationship to each other, a block fastened between the side walls at the second end portion of the side walls, a groove in the upper surface of the block, and a roller spring-biased into the groove.

38 Claims, 3 Drawing Sheets

Fig. 3.
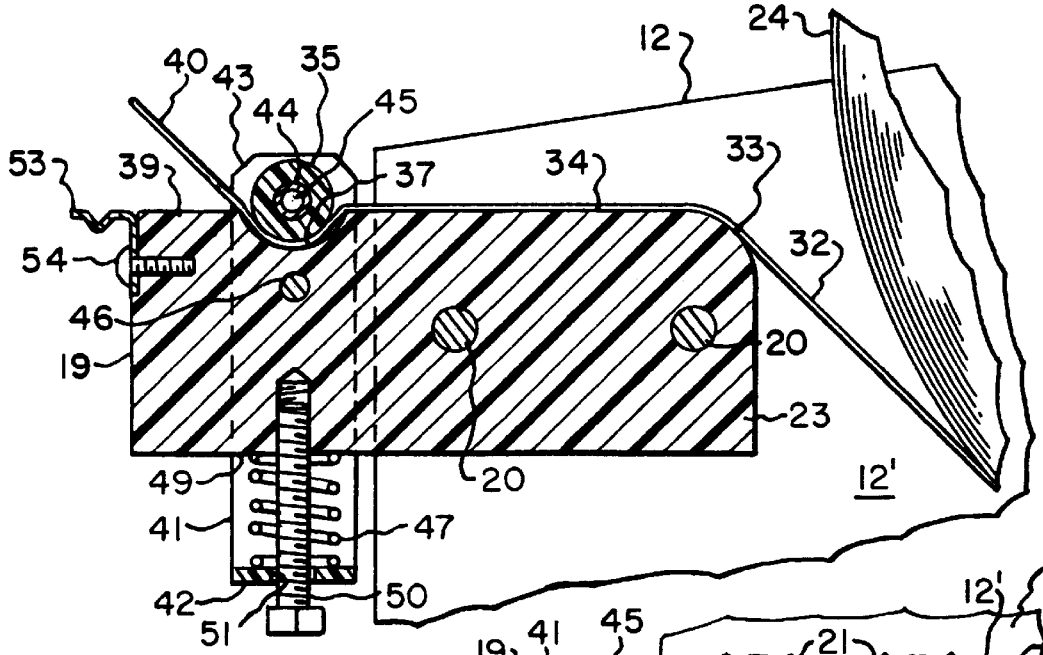
Fig. 5.
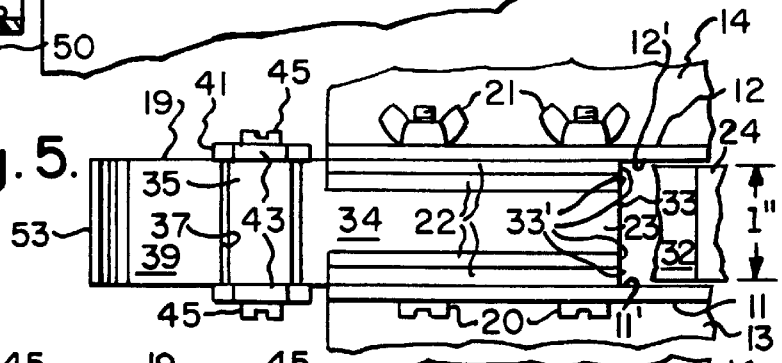
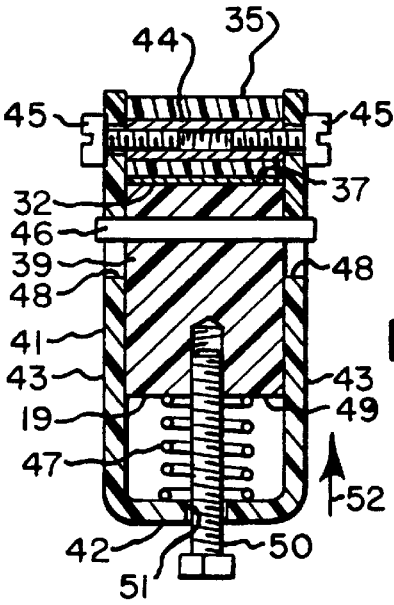
Fig. 4.
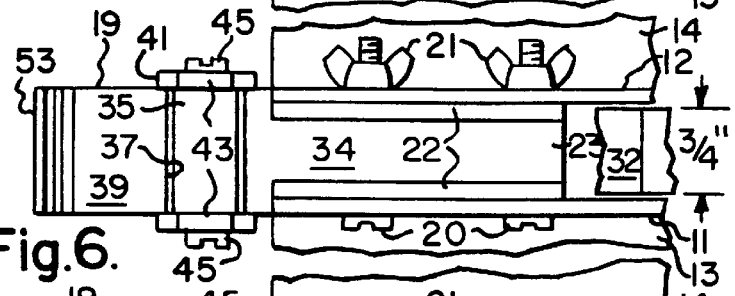
Fig. 6.
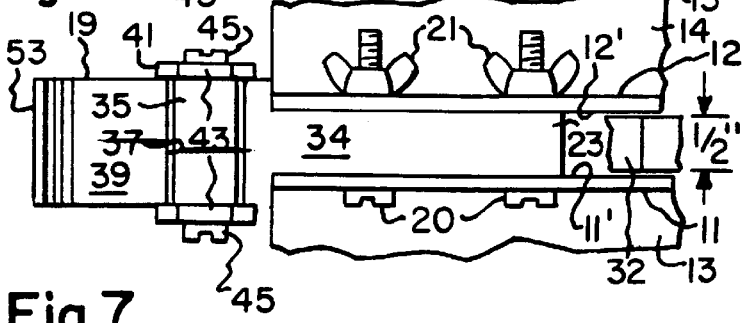
Fig. 7.

Fig. 8.
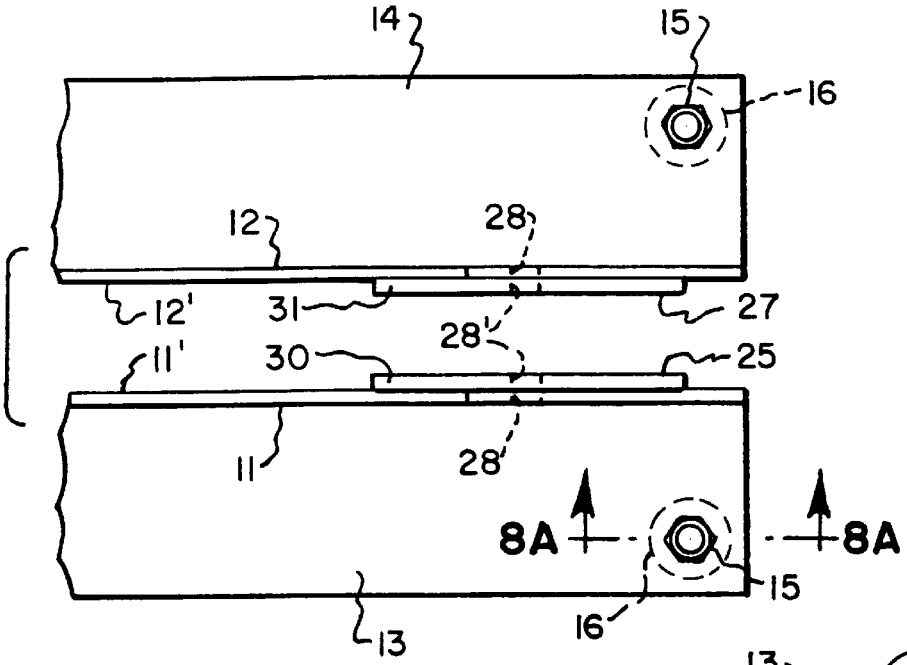
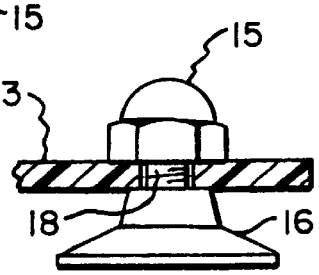
Fig. 8A.
Fig. 9.
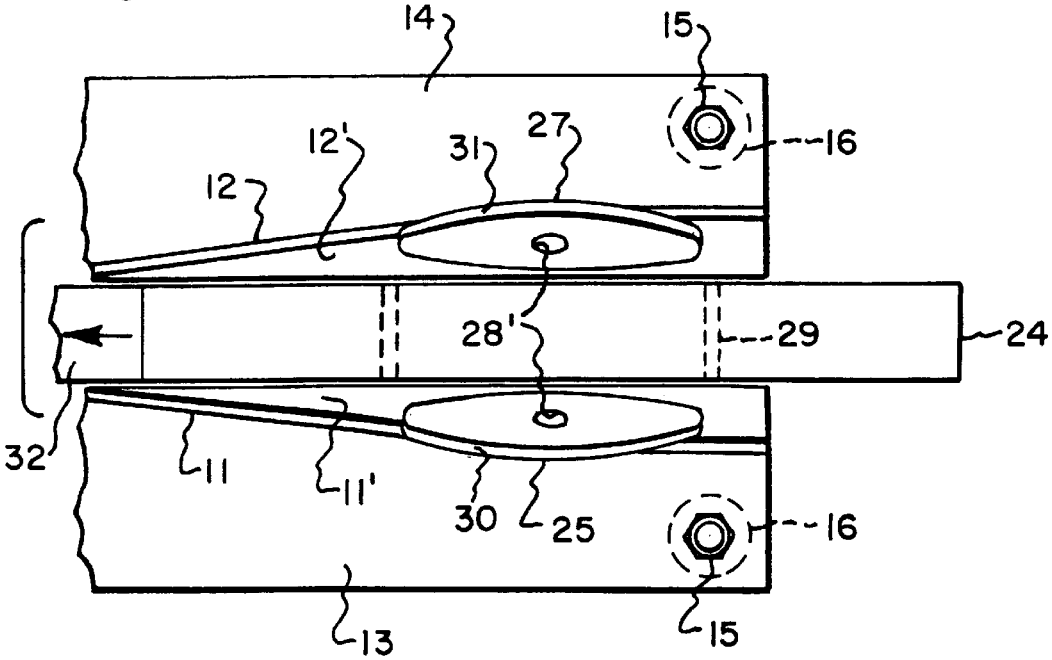

TAPE DISPENSER

BACKGROUND OF THE INVENTION

The present invention relates to a tape dispenser for dispensing tape from a roll of tape.

BRIEF SUMMARY OF THE INVENTION

It is one object of the present invention to provide an improved tape dispenser having structure which permits the mounting of a roll of tape and removing the empty core in an extremely simple and efficient manner.

Another object of the present invention is to provide an improved tape dispenser which orients the free end of the tape in such a manner that it can be grasped easily.

A further object of the present invention is to provide an improved tape dispenser which is extremely simple in construction and which can accept different widths of tape rolls. Other objects and attendant advantages of the present invention will readily be perceived hereafter.

The present invention relates to a tape dispenser comprising first and second spaced side walls, inner sides on said side walls, first and second end portions on said side walls, a hub member located on said inner side of at least one of said first and second side walls at said first end portion, said hub member being spaced from the inner side of said other of said first and second side walls, and a block fastened between said side walls at said second end portion.

The present invention also relates to a tape dispenser comprising a body, a block mounted on said body, a groove in said block, a roller in said groove, a bracket mounting said roller, and a spring coupling said bracket to said block and biasing said roller into said groove.

The various aspects of the present invention will be more fully understood when the following portions of the specification are read in conjunction with the accompanying drawings wherein:

BRIEF DESCRIPTION OF THE SEVERAL VIEWS OF THE DRAWING

FIG. 3 is an enlarged fragmentary cross sectional view taken substantially along line 3—3 of FIG. 1;

FIG. 4 is an enlarged cross sectional view taken substantially along line 4—4 of FIG. 2 and showing the structure for mounting the roller on the block which joins the dispenser sides and guides the tape;

FIG. 5 is a fragmentary plan view of the block and roller assembly mounted relative to the side walls of the dispenser for dispensing a one-inch tape;

FIG. 6 is a view similar to FIG. 5 but showing the block and roller assembly mounted between the side walls for dispensing a ¾ inch tape;

FIG. 7. is a view similar to FIGS. 5 and 6 but showing the block and roller assembly mounted between the side walls for dispensing a ½ inch tape;

FIG. 8 is a fragmentary enlarged plan view of the portions of the side walls and associated base members and showing the hub members mounted on the side walls;

FIG. 8A is a detail of the suction cup mounting structure taken substantially along line 8A—8A of FIG. 8; and FIG. 9 is a view similar to FIG. 9 but showing the side walls spread apart to receive a roll of tape.

DETAILED DESCRIPTION OF THE INVENTION

Figure 1:
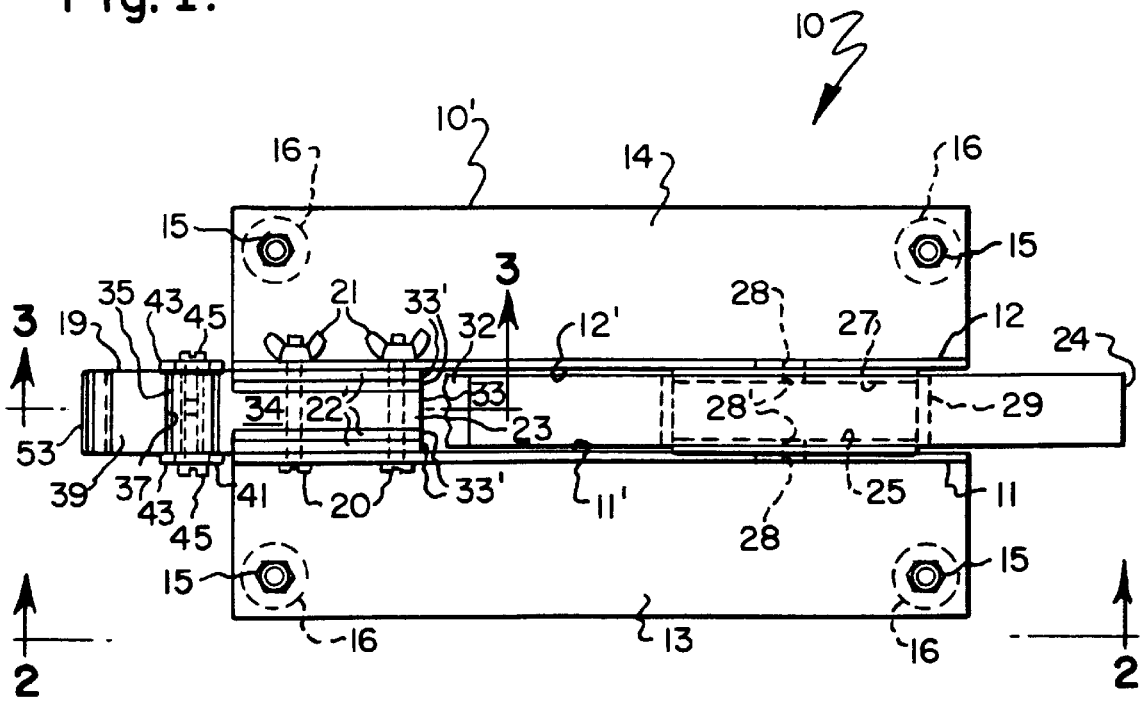
FIG. 1 is a plan view of the tape dispenser of the present invention taken substantially in the direction of arrows 1—1 of FIG. 2 with the tape roll fragmentarily shown thereon.

The tape dispenser 10 includes a body 10' having spaced side walls 11 and 12 having laterally extending base members 13 and 14, respectively, formed integrally therewith. As shown in FIG. 8A, suitable fasteners 15 thread onto threaded shanks 18 of suction cups 16 to secure suction cups 16 to base members 13 and 14. The suction cups 15 are used to firmly attach base members 13 and 14 to a smooth planar surface 17. The side walls and base members are formed of flexible resilient sheet plastic which has a memory so that the side walls 11 and 12 will return to the perpendicular orientation relative to their associated base members 13 and 14, respectively, if the side walls have been distorted from their normal relaxed positions shown in FIGS. 1 and 2 while suction cups 16 fasten base members 13 and 14 to the planar surface.

Figure 2:
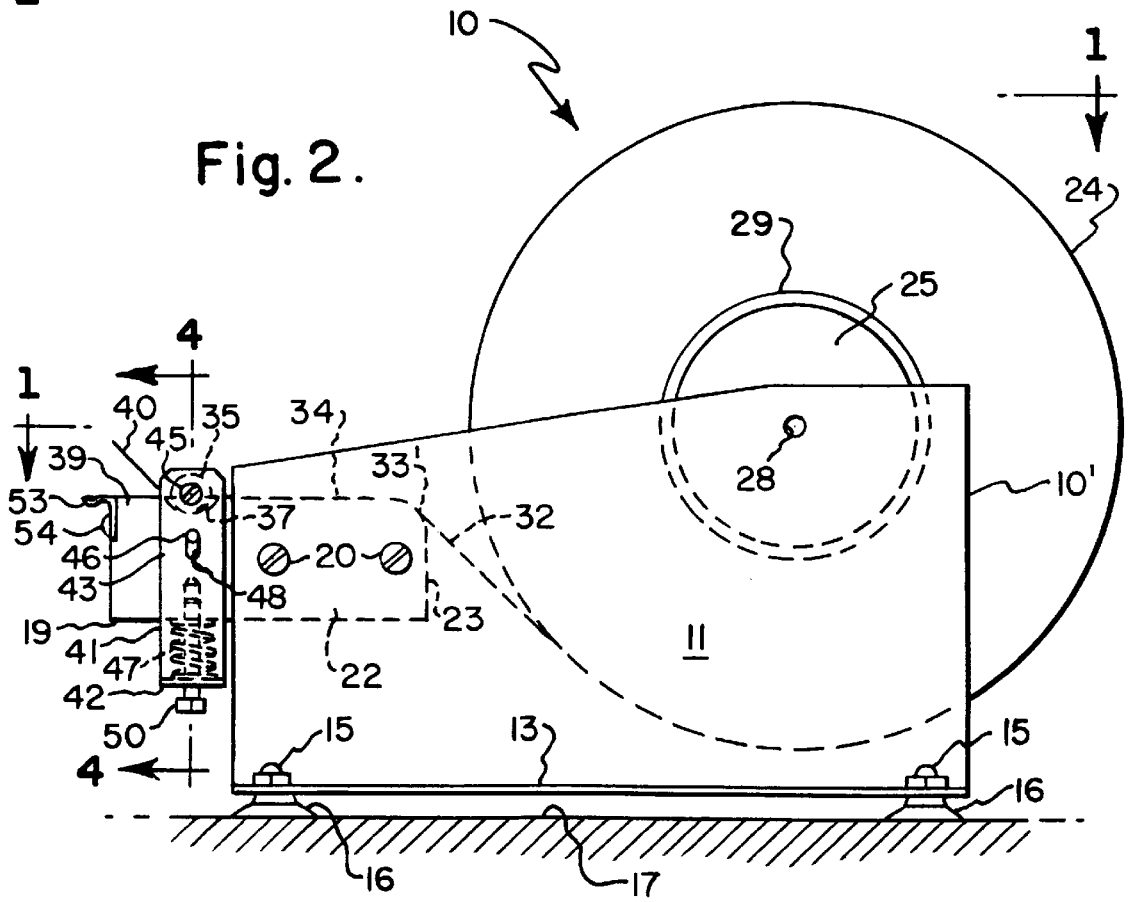
FIG. 2 is a side elevational view taken substantially in the direction of arrows 2—2 of FIG. 1.

A block 19 is secured between side walls 11 and 12 by bolts 20 having wing nuts 21 mounted thereon to permit block 19 to be selectively removed. Block 19 serves the dual function of being part of the only structure which joins sides 11 and 12 at one end portion thereof and which guides the tape which is being dispensed. In FIGS. 1, 2 and 5 spacers 22, which are approximately of the side elevational shape of block portion 23 (FIG. 2), are located between block portion 23 and side walls 11 and 12 so that the distance between the inner sides 11' and 12' of side walls 11 and 12, respectively, is approximately one inch for the purpose of receiving a roll of one inch wide tape.

Hub members 25 and 27, which are relatively thin cylindrical discs made of the same material as side walls 11 and 12, are bonded to side walls 11 and 12, respectively. Hub members 25 and 27 mount the hollow cylindrical core 29 of tape roll 24. In this respect, in order to mount tape roll 24, side walls 11 and 12 can be digitally spread apart (FIG. 9) so that the tape roll 24 can be inserted therebetween to the position shown in FIG. 9 while suction cups 16 hold base members 13 and 14 in their secured position on surface 12. After the tape roll 24 has reached the position shown in FIG. 9 wherein the hollow cylindrical core 29 is abreast of cylindrical discs 25 and 27, the side walls 11 and 12 are released whereupon they will return to the position shown in FIG. 8 because of their resilience and the memory of the plastic, and discs 25 and 27 will enter core 29 with their outer surfaces 30 and 31 rotatably supporting core 29. An alternate way of mounting tape roll 24 is by merely digitally spreading discs 25 and 27 sufficiently to receive the outer edge of roll 24, releasing the discs to permit them to bear on the outer edge of the roll, and thereafter moving the roll toward alignment between core 29 and hubs 25 and 27 until the latter snap into core 29 of the tape roll. After the tape has been used up, the core 29 is removed by slightly spreading side walls 25 and 27 so that core 29 will clear hub members 25 and 27. While both side walls 11 and 12 are flexible and resilient, it will be appreciated that only one side wall need have this characteristic, and that the other side wall may be rigid. The flexibility and resilience of the non-rigid side wall need only be to the extent that it can be spread sufficiently away from the rigid side wall so that a roll of tape can be installed and removed relative to the side walls.

It is to be noted that discs 25 and 27 do not rotate because, as noted above, they are bonded to the inner sides of side walls 11 and 12, thereby greatly simplifying the structure of the tape dispenser. The hub members 25 and 27 are positioned relative to their side walls 11 and 12, respectively, by temporarily mounting them on pins (not shown) which pass through holes such as 28 (FIG. 2) in side walls 11 and 12 and aligned holes 28' in discs 25 and 27. After the hub members are bonded to their associated side walls, the pins are removed.

In operation, the tape end 32 passes over the rounded edge 33 of block portion 23 and similar rounded edges 33' on spacers 22 and rides along the top surface 34 (FIG. 3) of block 19 and thereafter passes under roller 35 which is spring-biased into groove 37 of wide portion 39 of block 19. Because of the arrangement of the roller 35 being biased into groove 37, the extreme outer end 40 of the tape will assume an inclined position such as shown in FIGS. 2 and 3 so that it may be easily graspable.

The roller 35 is mounted on block portion 39 by U-shaped bracket 41 (FIG. 4) having a web 42 and upstanding legs 43. Roller 35 is rotatably mounted on shaft 44 which is retained between legs 43 by bolts 45. A spring 47 is located between the underside 49 of block portion 39 and web 42, thereby biasing the bracket 41 downwardly so that roller 35 is biased into groove 37. A pin 46 is secured in block portion 39, and its outer ends ride in slots 48 in bracket legs 43. A pin 50 in the nature of a threaded bolt is centrally located within the spring 47 and is threaded into block portion 39. The shank of bolt 50 passes through aperture 51 in web 42 so that the shank and pin 46 act as guides for vertical movement of bracket 41 when it is digitally pushed upwardly in the direction of arrow 52 to move roller 35 out of groove 37 during the process of threading the tape end between roller 35 and groove 37. When bracket 41 is released, the spring 47 will return roller 35 to the position shown in FIGS. 3 and 4.

A blade 53 is secured to the outer end of block portion 39 by a screw 54, and thus when it is desired to sever a portion of tape from the outer end 40 thereof, the tape end is forced down over the edge of blade 53 in the conventional manner. After the end of the tape has been severed, the remaining end portion 40 will assume the inclined position shown in FIG. 3 because of the roller 35 being biased into groove 37 and because of the distance between roller 35 and blade 53 and because of the stiffness of the tape itself. The outer end 40 of the tape is easily graspable because it assumes the inclined position.

In FIGS. 1–5 an arrangement is shown for dispensing tape which is one inch wide. This is achieved by using two spacers 22 on each side of narrow block portion 23 (FIG. 5). In FIG. 6 an arrangement is shown for dispensing ¾ inch tape. In this regard, only one spacer 22 is used on each side of narrow block portion 23. In FIG. 7 the arrangement is shown for dispensing ½ inch tape. In this respect, there are no spacers 22 used and side walls 11 and 12 bear directly on block portion 23.

Whenever a tape is to be dispensed which is of a different width of the tape which was previously dispensed, at least one base member 13 or 14 has to be detached from its surface 17 so that the side walls 11 and 12 can be moved the appropriate distance apart. Generally the spacing may be effected by mounting a core of a roll of tape onto one of the hub members 25 or 27 and thereafter inserting the other hub member into the core and thereafter pressing the base member 13 or 14 downwardly so as to cause the suction cups thereon to secure the base member to its associated surface.

In a model which was built, the side walls 11 and 12 with their integral base members 13 and 14, respectively, were fabricated of polyethyleneterephthalate glycol. However, it will be appreciated that any other suitable material may be used. Also, when one side wall is sheet plastic, the other side wall need not be sheet plastic, that is the non-plastic side wall may be made out of any other material. Furthermore, the tape of roll 24 is of the cohesive type, and it is dispensed with the cohesive side facing upwardly. It will be appreciated, however, that other types of tape may also be dispensed, and such other types will also have their free ends inclined as shown in FIG. 3.

While the hub members 25 and 27 have been disclosed as the preferred hub structure for supporting the roll of tape, it will be appreciated that other types of hub structure can also serve this purpose. In this respect, one sufficiently wide disc can be used on one side wall 11 or 12 if the opposed resilient side wall holds the core on such a disc. By way of example, the discs 25 and 27 of the tape dispenser model 10 are 3/16 inch wide. A disc ⅜ inch wide on one side 11 or 12 can support the roll when the latter is biased onto such a disc by the opposed side wall. However, if the single disc is sufficiently wide, the opposed side wall need only act as a border for the roll without biasing it onto the disc. In addition, another type of hub structure for supporting the roll would be by hub members comprising a series of spaced protuberances on one or both side walls 11 and 12 having outer edges which lie on a circle which fit within core 29 in contacting relationship. Also the hub members could be a combination of a disc on one side wall 11 or 12 and a plurality of protuberances on the other side wall.

While suction cups 16 have been shown as the preferred way of attaching the base members 13 and 14 to a surface, it will be appreciated that other forms of attachments may be used, including but not limited to clamps and screw arrangements which permit at least one base member 13 or 14 to be moved toward and away from the other base member during the process of mounting different widths of tape.

While preferred embodiments of the present invention have been disclosed, it will be appreciated that the present invention is not limited thereto but may be otherwise embodied within the scope of the following claims.

We claim:

1. A tape dispenser comprising first and second spaced side walls, inner sides on said side walls, first and second end portions on said side walls, a hub member located on said inner side of at least one of said first and second side walls at said first end portion, said hub member being spaced from the inner side of said other of said first and second side walls, a block fastened between said side walls at said second end portion, a groove in said block, a roller, and a spring biasing said roller into said groove.

2. A tape dispenser as set forth in claim 1 including a second hub member located on said inner side of said other of said first and second side walls and spaced from said hub member.

3. A tape dispenser as set forth in claim 2 wherein said hub members are discs.

4. A tape dispenser as set forth in claim 2 wherein at least one of said first and second side walls is flexible and resilient.

5. A tape dispenser as set forth in claim 4 wherein said hub members are discs.

6. A tape dispenser as set forth in claim 4 wherein at least one of said side walls is sheet plastic.

7. A tape dispenser as set forth in claim 6 wherein said hub members are discs.

8. A tape dispenser as set forth in claim 1 wherein at least one of said first and second side walls is flexible and resilient.

9. A tape dispenser as set forth in claim 8 wherein at least one of said side walls is sheet plastic.

10. A tape dispenser as set forth in claim 1 including a base connected to said side walls.

11. A tape dispenser as set forth in claim 10 including a second hub member located on said inner side of said other of said first and second side walls and spaced from said hub member.

12. A tape dispenser as set forth in claim 11 wherein said hub members are discs.

13. A tape dispenser as set forth in claim 12 wherein at least one of said first and second side walls is flexible and resilient.

14. A tape dispenser as set forth in claim 10 wherein said base comprises first and second base members extending laterally outwardly from said first and second side walls, respectively.

15. A tape dispenser as set forth in claim 14 wherein said first and second base members are formed integrally with said first and second side walls, respectively.

16. A tape dispenser as set forth in claim 15 wherein at least one of said first and second side walls is flexible and resilient.

17. A tape dispenser as set forth in claim 16 including a second hub member located on said inner side of said other of said first and second side walls and spaced from said hub member.

18. A tape dispenser as set forth in claim 17 wherein at least one of said side walls and base members is formed of sheet plastic.

19. A tape dispenser as set forth in claim 18 wherein said hub members are discs.

20. A tape dispenser as set forth in claim 14 including suction cups on said base.

21. A tape dispenser as set forth in claim 20 wherein at least one of said first and second side walls is flexible and resilient.

22. A tape dispenser as set forth in claim 21 wherein said first and second base members are formed integrally with said first and second side walls, respectively.

23. A tape dispenser as set forth in claim 22 including a second hub member located on said inner side of said other of said first and second side walls and spaced from said hub member.

24. A tape dispenser as set forth in claim 23 wherein said hub members are discs.

25. A tape dispenser as set forth in claim 24 wherein at least one of said side walls is sheet plastic.

26. A tape dispenser as set forth in claim 10 including means on said base for securing said base to a surface.

27. A tape dispenser as set forth in claim 26 wherein at least one of said first and second side walls is flexible and resilient.

28. A tape dispenser as set forth in claim 27 including a second hub member located on said inner side of said other of said first and second side walls and spaced from said hub member.

29. A tape dispenser as set forth in claim 28 wherein said hub members are discs.

30. A tape dispenser as set forth in claim 29 wherein at least one of said side walls is sheet plastic.

31. A tape dispenser as set forth in claim 30 wherein said base comprises first and second base members extending laterally outwardly from said first and second side walls, respectively.

32. A tape dispenser comprising a body, a block mounted on said body, a tape-reaciving groove in said block, a roller, and a spring biasing said roller into said groove.

33. A tape dispenser as set forth in claim 32 wherein said roller is mounted on a bracket, and wherein said spring is positioned between said bracket and said block.

34. A tape dispenser as set forth in claim 32 including a blade mounted on said block in spaced relationship to said roller.

35. A tape dispenser as set forth in claim 1 including fasteners removably fastening said block between said side walls.

36. A tape dispenser comprising at least one side wall, a hub member on said at least one side wall, a member spaced from said hub member, a tape-receiving groove in said member, a roller, and a spring biasing said roller into said groove.

37. A method of dispensing a tape from a tape dispenser comprising the steps of mounting a tape on said tape dispenser, providing a groove in said tape dispenser, biasing a roller into said groove, and passing a tape between said biased roller and said groove to cause the extreme outer end of said tape to be unsupported throughout its extent.

38. A method of dispensing a tape from a tape dispenser as set forth in claim 37 including the step of providing a blade in spaced relationship to said groove, pulling said extreme outer end of said tape beyond said blade, severing said extreme outer end of said tape at said blade to cause the adjacent portion of said tape to become its extreme outer end to then become unsupported throughout its extent because of the biasing of said roller into said groove.

* * * * *